US009278532B2

(12) United States Patent
Asai et al.

(10) Patent No.: US 9,278,532 B2
(45) Date of Patent: Mar. 8, 2016

(54) PROCESS FOR PRODUCING LIQUID EJECTION HEAD

(71) Applicant: CANON KABUSHIKI KAISHA, Tokyo (JP)

(72) Inventors: Kazuhiro Asai, Kawasaki (JP); Tetsuro Honda, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 589 days.

(21) Appl. No.: 13/654,763

(22) Filed: Oct. 18, 2012

(65) Prior Publication Data

US 2013/0106017 A1 May 2, 2013

(30) Foreign Application Priority Data

Nov. 1, 2011 (JP) ..... 2011-240299

(51) Int. Cl.
*B41J 2/16* (2006.01)
*B41J 2/14* (2006.01)

(52) U.S. Cl.
CPC ..... *B41J 2/1603* (2013.01); *B41J 2/1629* (2013.01); *B41J 2/1631* (2013.01); *B41J 2/1632* (2013.01); *B41J 2/1635* (2013.01); *B41J 2/1639* (2013.01); *B41J 2/1645* (2013.01); *B41J 2202/11* (2013.01)

(58) Field of Classification Search
CPC ..... B41J 2/1648; B41J 2/235; B41J 2/00; B41J 2/2005; B41J 2/135; B41J 2/16; G01D 15/16; B29C 39/26; B29C 33/40; B29C 33/42; B29C 33/3842
See application file for complete search history.

(56) References Cited

U.S. PATENT DOCUMENTS 6,467,876 B1 * 10/2002 Karasawa ..... B41J 2/14 347/45
6,762,012 B2 7/2004 Kim et al.
6,799,831 B2 10/2004 Inamoto et al.
7,533,960 B2 5/2009 Yasuda et al.

(Continued)

FOREIGN PATENT DOCUMENTS

CN 1404995 A 3/2003
CN 1417033 A 5/2003
CN 1982066 A 6/2007

(Continued)

OTHER PUBLICATIONS

English translation of Japanese patent JP 11138817 by Sato, Kanki, May 1999.*

(Continued)

*Primary Examiner* — Matthew Daniels
(74) *Attorney, Agent, or Firm* — Fitzpatrick, Cella, Harper & Scinto

(57) ABSTRACT

The present invention provides a process for producing a liquid ejection head, the process including: (1) forming a mold pattern of a liquid flow path and a base pattern surrounding the mold pattern on a substrate, (2) disposing a covering layer to cover the mold pattern and the base pattern, (3) forming at least an ejection orifice in the covering layer to form an orifice plate, and (4) removing the mold pattern and the base pattern, in which the base pattern has such a form that the orifice plate is formed to have a side wall portion constituting a side wall of the liquid flow path and a plurality of support structures that are disposed on the substrate in a peripheral region of the side wall portion and support an upper surface portion constituting an upper wall of the orifice plate.

8 Claims, 7 Drawing Sheets

(56) References Cited

U.S. PATENT DOCUMENTS

| | | | | |
|---|---|---|---|---|
| 2002/0013014 | A1* | 1/2002 | Jiang | H01L 23/49827 438/106 |
| 2009/0156001 | A1* | 6/2009 | Hsu et al. | 438/667 |

FOREIGN PATENT DOCUMENTS

| | | | | |
|---|---|---|---|---|
| EP | 0859099 | A2 * | 8/1998 | |
| JP | 1-80344 | U | 5/1989 | |
| JP | 10157150 | A * | 6/1998 | B41J 2/16 |
| JP | 11-138817 | A | 5/1999 | |
| JP | 11138817 | A * | 5/1999 | B41J 2/05 |
| JP | 2007-001241 | A | 1/2007 | |

OTHER PUBLICATIONS

English translation of Japanese patent JP 10157150 by Sato, Kanki, Jun. 1998.*

Office Action in Chinese Application No. 201210419847.4 (dated Jun. 3, 2014).

* cited by examiner

FIG. 3A1
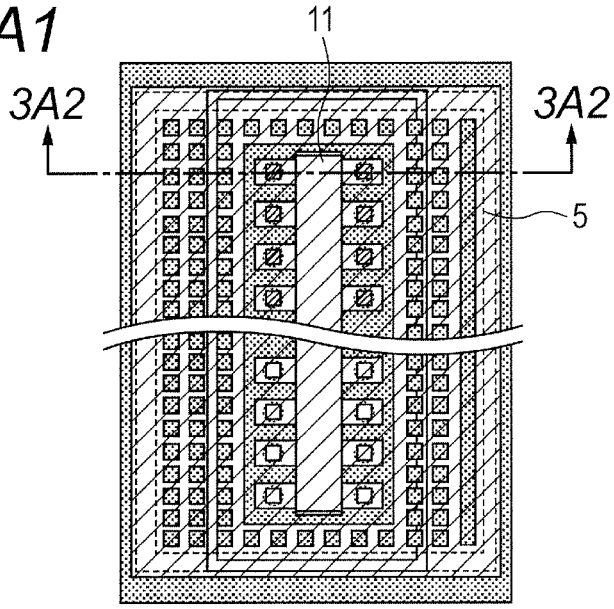
FIG. 3A2
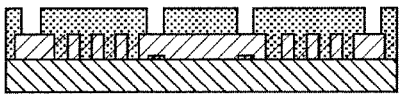
FIG. 3B1
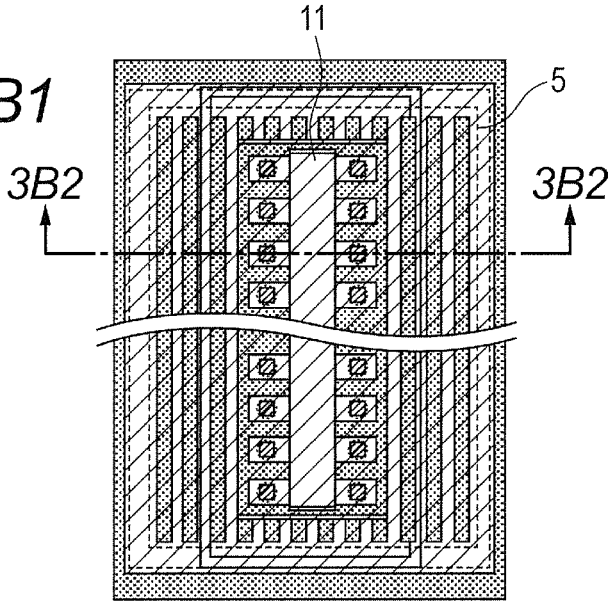
FIG. 3B2
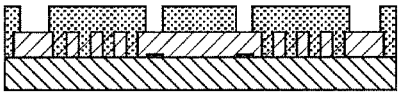

FIG. 3C1
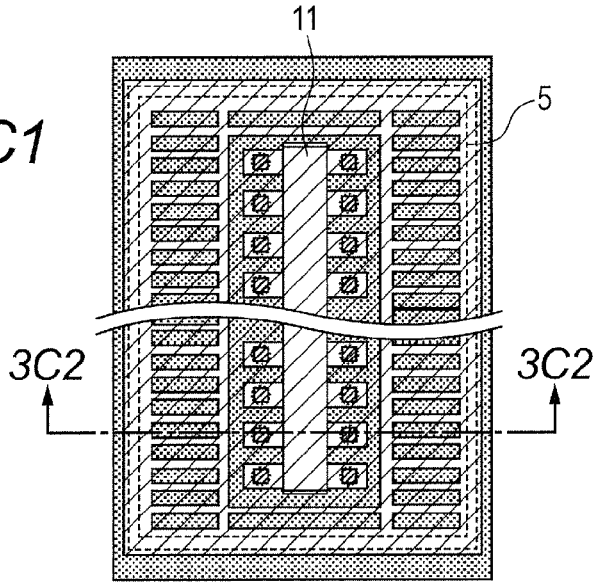
FIG. 3C2
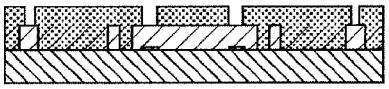
FIG. 4A1
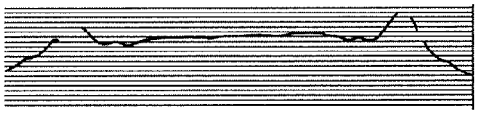
FIG. 4A2
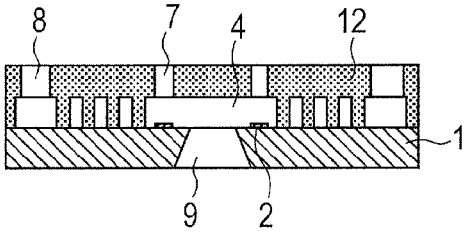
FIG. 4B1
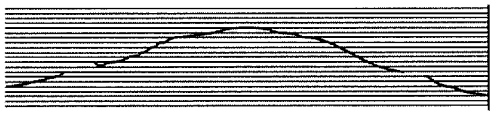
FIG. 4B2
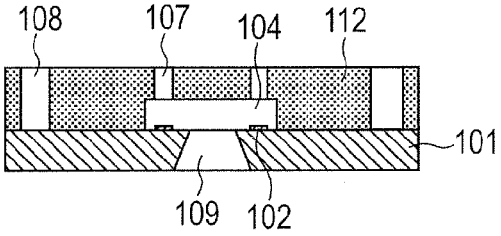

PROCESS FOR PRODUCING LIQUID EJECTION HEAD

BACKGROUND OF THE INVENTION

1. Field of the Invention

The present invention relates to a process for producing a liquid ejection head for ejecting a liquid, preferably to an ink jet recording head for ejecting a droplet of a recording liquid such as ink.

2. Description of the Related Art

There is, among other inkjet printing systems, a system called a "side shooter type print head" in which a liquid droplet of ink is ejected perpendicular to a substrate on which an ejection energy generating element is formed. The side shooter type print head has rapidly become popular these few years because it can print using a small liquid droplet by shortening the distance between an ejection energy generating element and an orifice.

Further, recently, with development of a recording technology for high resolution and high image quality, it is demanded that the distance between an ejection energy generating element and an orifice plane be more accurate.

Japanese Patent Application Laid-Open No. H11-138817 discloses that an ink jet recording head having an excellent flatness of an orifice plane is manufactured by providing a base 105 on a substrate 101 to surround a mold pattern 111 of an ink flow path when disposing a covering layer, as illustrated in FIGS. 5A and 5B.

However, a demand for further high speed printing causes an increase in the number of nozzles and length of an ink flow path, and the area of an ink flow path in a chip accordingly tends to be larger. When the area of the ink flow path is larger, the coatability of a covering layer constituting a nozzle becomes lower, and there may be a variation in distance between an ejection energy generating element and an orifice plane, so that the flatness of the orifice plane can be lowered.

If the method described in Japanese Patent Application Laid-Open No. H11-138817 is used as a solution for the problem described above, the flatness of the orifice plane, as illustrated in FIG. 6A, can be improved by widening the base 105 and shortening the distance between the mold pattern 111 of the ink flow path and the base 105. However this method, as shown in FIGS. 6B and 6C, provides an eaves structure on the side of the ink flow path, and an orifice plate 112 may be accordingly damaged.

Therefore, an object of the present invention is to provide a process for producing a print head having an excellent flatness of an orifice plane and a high strength of an orifice plate.

SUMMARY OF THE INVENTION

The present invention provides a process for producing a liquid ejection head including an orifice plate having an ejection orifice for ejecting a liquid and a liquid flow path in communication with the ejection orifice, and a substrate having an ejection energy generating element for generating energy for ejecting the liquid, the process including: (1) forming a mold pattern of the liquid flow path and a base pattern surrounding the mold pattern on the substrate, (2) disposing a covering layer to cover the mold pattern and the base pattern, (3) forming at least the ejection orifice in the covering layer to form the orifice plate, and (4) removing the mold pattern and the base pattern, in which the base pattern is formed in such a form that the orifice plate includes a side wall portion constituting a side wall of the liquid flow path, and a plurality of support structures that are disposed on the substrate in a peripheral region of the side wall portion and support an upper surface portion constituting an upper wall of the orifice plate.

The present invention can provide a process for producing a liquid ejection head having an excellent flatness of an orifice plane and a high strength of an orifice plate. Therefore, a liquid ejection head having excellent ejection accuracy and excellent durability can be provided.

Further features of the present invention will become apparent from the following description of exemplary embodiments with reference to the attached drawings.

BRIEF DESCRIPTION OF THE DRAWINGS

FIGS. 3A1, 3A2, 3B1, 3B2, 3C1 and 3C2 are schematic, top plan views showing an example of layout for a base pattern and a support structure in a process corresponding to that shown in FIG. 1D.

FIGS. 4A1, 4A2, 4B1 and 4B2 are schematic views for illustrating the flatness of an ink jet recording head according to an exemplary embodiment.

DESCRIPTION OF THE EMBODIMENTS

Preferred embodiments of the present invention will now be described in detail in accordance with the accompanying drawings.

Hereinafter, taking an example of an ink jet recording head as an application example, the present invention will be described. However, the applicable scope of the present invention is not limited to this example, and the present invention can also apply to, for example, biochip production and a liquid ejection head for printing an electronic circuit. The liquid ejection head may also include, for example, a head for producing color filter, in addition to the ink jet recording head.

Hereinafter, exemplary embodiments of the present invention will be described with reference to the drawings.

Figure 7A:
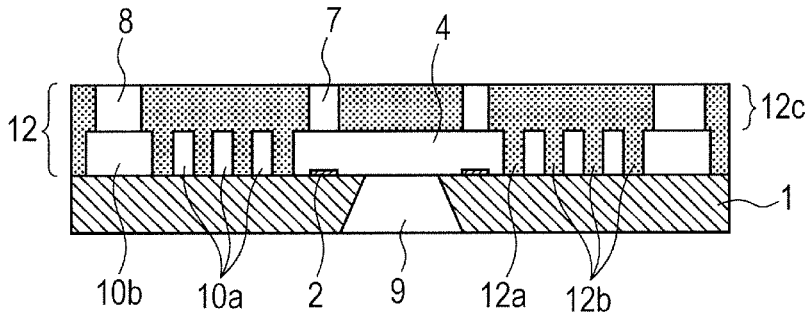
FIGS. 7A and 7B are schematic, cross-sectional views showing an example of a liquid ejection head according to an exemplary embodiment.
Figure 7B:
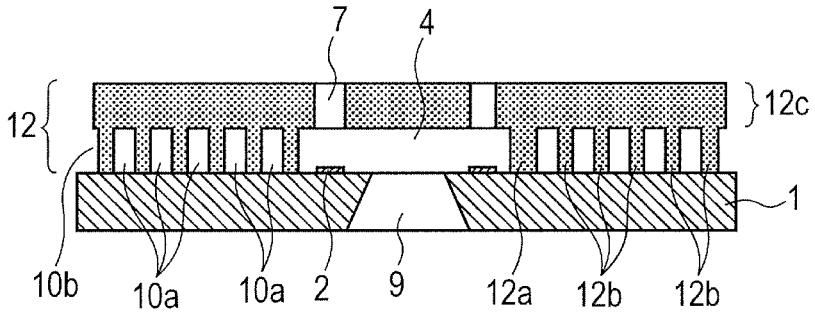

FIGS. 7A and 7B are schematic, cross-sectional views showing an example of a configuration of an ink jet recording head according to an exemplary embodiment. This ink jet recording head (liquid ejection head) includes a substrate 1 formed by arraying two rows of ejection energy generating elements 2 such as a heating resistive element side by side with a predetermined pitch. The substrate may be, for example, a silicon substrate. The substrate 1 has an ink supply port (liquid supply port) 9 formed between the two rows of the ejection energy generating elements 2 therein.

On the substrate 1, an orifice plate 12 is formed by a covering layer. The orifice plate 12 is configured to have an ejection orifice 7 that is open at a position corresponding to each of the ejection energy generating elements 2, and an ink flow path (liquid flow path) 4 in communication with each ink ejection orifice 7 from the ink supply port 9.

Further, the orifice plate 12 includes an upper surface portion 12*c* constituting an upper wall of the orifice plate, a side wall portion 12*a* constituting a side wall of the ink flow path 4, and a plurality of support structures 12*b* that is disposed on the substrate 1 in a peripheral region of the side wall portion 12*a* and supports the upper surface portion 12*c*. The respective support structures 12*b* may, for example, be in a pillar form or a wall form.

Additionally, in FIGS. 7A and 7B, a portion 10 (including 10*a* and 10*b*) is a base pattern removed portion where a base pattern has been removed. The portion 10*b* of them is the base pattern removed portion in an outmost periphery. In FIG. 7A, a through-hole 8 is provided which communicates with this base pattern removed portion in the outmost periphery. From the through-hole 8, the base pattern is removed. The orifice plate shown in FIG. 7B does not have the through-hole 8 provided therein, but the through-hole can be formed in such a way that the base pattern is exposed on a side of the covering layer, and the base pattern is then melted and removed from the side of the orifice plate.

Exemplary Embodiment 1

A production process according to an exemplary embodiment will be described below.

An ink jet recording head shown in FIG. 7A was produced according to procedures shown in FIGS. 1A to 1E.

Figure 1A:
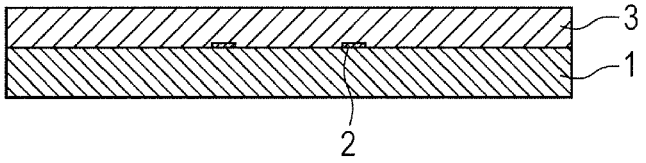
FIGS. 1A, 1B, 1C, 1D and 1E are schematic, cross-sectional process views for illustrating an example of a process for producing a liquid ejection head according to an exemplary embodiment.

First, as shown in FIG. 1A, on a substrate 1 having an ejection energy generating element 2 formed on a surface (a first surface) thereof, for example, a soluble resin 3 is disposed.

The soluble resin may include, but particularly not limited to, for example, polymethyisopropenylketone (commercially available under the name of ODUR-1010 from TOKYO OHKA KOGYO CO., LTD.). A placement process may include, but particularly not limited to, for example, a spin coat method.

Figure 1B:
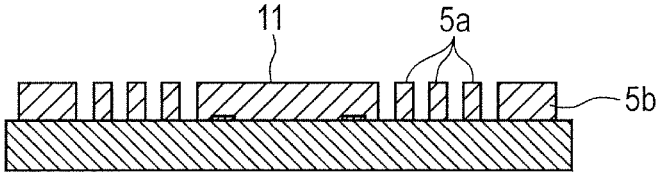

Next, as shown in FIG. 1B, the soluble resin 3 is patterned using a photolithography technique to pattern a mold pattern 11 to be a mold material for an ink flow path and a base pattern 5 (including 5*a* and 5*b* in FIGS. 1A to 1E) functioning as a base. Forming the base pattern 5 can allow a covering layer to be disposed with a better flatness in a later process, thus improving the flatness of an orifice plane.

Now, the form of the base pattern will be described.

The base pattern is formed in such a form that the resultant orifice plate has a side wall portion constituting a side wall of an ink flow path, and a plurality of support structures that re disposed on the substrate in the peripheral region of the side wall portion and support an upper surface portion constituting an upper wall of the orifice plate. Forming the base pattern in such a form around the mold pattern can allow the base to be provided in the wide range of the periphery around the mold pattern and close to the mold pattern. That is, when the base pattern is formed such that the resultant orifice plate has support structures, the strength of the resultant orifice plate after the base pattern was removed can be secured even if the base pattern is formed extensively. Accordingly, the base pattern can be provided extensively and close to a mold pattern of the ink flow path. Therefore, the present invention can provide the orifice plane having a better flatness and the ink jet recording head having excellent durability.

The form of the base pattern may include, for example, a mesh form. The mesh form may be, for example, a lattice form. The base pattern having the lattice form may include, for example, layout examples shown in FIGS. 3A1, 3B1 and 3C1. It is noted that FIGS. 3A2, 3B2 and 3C2 are schematic, cross-sectional views taken along 3A2-3A2, 3B2-3B2 and 3C2-3C2 lines in FIGS. 3A1, 3B1 and 3C1, respectively.

As shown in FIGS. 3A1, 3A2, 3B1, 3B2, 3C1 and 3C2, the side wall portion is formed by the covering layer disposed between the base pattern and the mold pattern. Also, the covering layer disposed in a fine pattern of the base pattern forms the support structure.

In FIG. 3A1, the base pattern 5 is disposed to surround the mold pattern 11 of the ink flow path and has a lattice form. The base pattern shown in FIG. 3A1 has the lattice form at least on both sides of the mold pattern. If the base pattern as shown in FIG. 3A1 is formed, the support structure of the resultant orifice plate is in a pillar form. The length of one side of the lattice can be between 10 and 80 μm. Also, the distance between the side of the mold pattern of the ink flow path and a side of the base pattern opposing to the side of the mold pattern of the ink flow path is preferably in the range from 3 to 80 μm, more preferably in the range from 10 to 40 μm. This distance set to be equal to or larger than 3 μm can maintain the adhesiveness with the substrate. Further, this distance set to be equal to or smaller than 80 μm can allow the orifice plate to be more flat.

Further, if the base pattern is formed as shown in FIG. 3B1 or 3C1, the support structure of the orifice plate can be obtained in a wall form. It is noted that the base pattern 5 preferably surrounds the mold pattern 11 all around, but there may be a disconnected portion as shown in FIG. 3A1. Also, it preferably surrounds the mold pattern 11 of the ink flow path all in four directions, but it may surround to sandwich the mold pattern 11 only in two directions.

Furthermore, preferably, considering that the base pattern is dissolved and removed in a later process, the form is selected. For example, as shown in FIGS. 3A1, 3B1 and 3C1, the base pattern 5 can be formed so that an inner base pattern portion 5*a* communicates with an external base pattern portion 5*b*. Since the base pattern is removed from the covering layer in a later process, a through-hole can be formed to communicate with the external base pattern portion 5*b*. Alternatively, also, the base pattern can be formed so that the external base pattern portion 5*b* is exposed on a side of the chip, and then the base pattern can be removed from the side of the chip in a later process.

The mold pattern and the base pattern preferably have the same material. Also, the mold pattern and the base pattern are preferably patterned at the same time using the same material.

Figure 1C:
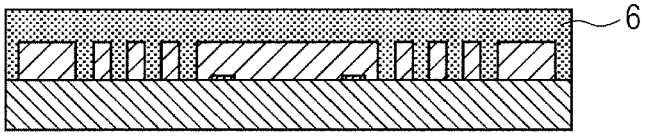

Then, as shown in FIG. 1C, a covering layer 6 is formed on the mold pattern 11 and the base pattern 5 using a resin or the like.

A placement process may include, but particularly not limited to, for example, a spin coat method.

The resin for forming the covering layer may include, but particularly not limited to, for example, a negative photosensitive resin.

The solid content concentration of the resin in the covering layer is, for example, between 40 and 60 percent by mass, more particularly, is about 50 percent by mass.

Figure 1D:
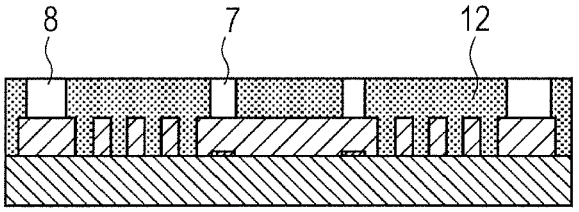

Next, as shown in FIG. 1D, in the covering layer, an ink ejection orifice 7 and a through-hole 8 are formed to provide an orifice plate 12.

The ink ejection orifice 7 and the through-hole 8 can be formed, for example, by lithographic exposure of ultraviolet light, Deep-UV light or the like. For example, if a negative photosensitive resin is used as a resin for the covering layer, an exposure treatment is carried out except positions at which the ink ejection orifice 7 and the through-hole 8 are formed, and a development treatment is performed.

The through-hole 8 can be formed away from the ink ejection orifice 7 by the distance in the range from 100 to 200 μm to control a possibility of the through-hole 8 to be ink retention when the head is formed. If the through-hole 8 turns into the ink retention, there may be a possibility that the ejection direction is shifted at ejection, or that a desired size of a liquid droplet is not achieved.

FIG. 3A1 is a schematic, top plan view corresponding to the process shown in FIG. 1D. The through-hole 8, but particularly not limited to, can be formed to communicate with the base pattern portion 5*b* formed in the outer periphery. For example, as shown in FIG. 3A1, the through-hole 8 can be formed to communicate with the base pattern portion 5*b* formed in the outer periphery. It is noted that in FIG. 3A1, a position at which the through-hole is formed is shown by a portion surrounded by two dotted lines.

In FIGS. 1A to 1E, the base pattern portion in the outer periphery of the base pattern is shown by the reference symbol "5*b*", and the inner base pattern portion of the base pattern is shown by the reference symbol "5*a*". The resin gets into the base pattern, thereby the support structure is formed. In FIGS. 3A to 3C, the base pattern 5 including the external base pattern portion 5*b* and the inner base pattern portion 5*a* is arrayed in a lattice pattern. The support structure formed by the base pattern is, for example, in a pillar structure as shown in FIG. 3A, or in a wall structure as shown in FIG. 3B or 3C, but the support structure is not limited to these. The pillar structure may include, but not limited to, for example, a columnar structure, an elliptical pillar structure or a polygonal column structure. The wall structure may include, but not limited to, for example, a rectangular form.

Figure 1E:
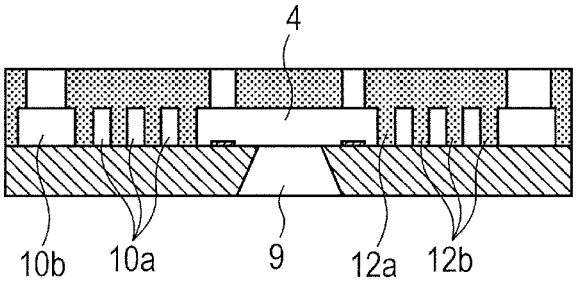

Next, as shown in FIG. 1E, the substrate 1 is etched from the back side (second surface) to form an ink supply port (liquid supply port) 9 therein.

The ink supply port 9 can be formed, for example, by chemically etching the substrate. For example, when the substrate 1 is a silicon substrate, the ink supply port 9 can be formed by anisotropic etching using a strong alkali solution such as KOH, NaOH or TMAH. As a more particular example, the ink supply port 9 can be formed by etching the silicon substrate having the crystal orientation <100> using a TMAH solution.

Further, the mold pattern 11 of the ink flow path and the base pattern 5 are removed. The mold pattern 11 is dissolved and removed from the ink ejection orifice 7 and the ink supply port 9, and the base pattern 5 from the through-hole 8. Accordingly, an ink flow path 4 (including a liquid chamber above the ejection energy generating element 2 in which an air bubble is produced) is formed.

A base pattern removed portion, which is a portion where the base pattern has been removed, becomes empty, and in FIG. 1E, a portion 10*a* is a portion where there was the inner base pattern portion 5*a* and a portion 10*b* is a portion where there was the external base pattern portion 5*b*.

Also, the orifice plate, as described above, is configured to include the side wall portion 12*a* constituting the side wall of the ink flow path, and a support portion having a support structure that is disposed on the substrate 1 in the peripheral region of the side wall portion 12*a* and supports the upper surface portion 12*c*.

A process for removing the mold pattern and the base pattern formed of a soluble resin may include, for example, a process in which entire surface exposure is carried out using Deep-UV light, and subsequently a development treatment is performed. Furthermore, at development treatment, an ultrasonic wave may be, as needed, used.

Next, the substrate in which the orifice plate was formed according to the above process is one-by one separated and cut for each of the ink jet recording heads by a dicing saw. Then, the ink jet recording head is provided with an electric junction to drive the ejection energy generating element 2, and subsequently, to the ink jet recording head, a chip tank member for ink supply is connected, thereby completing the ink jet recording head.

According to the present invention, the base patterned to surround the mold pattern of the ink flow path can have a larger installation area, as described above. Therefore, because the orifice plate can be intended to be more flat as shown in FIGS. 4A1 and 4A2, the distance between the ejection energy generating element 2 and the orifice plane can be accurately achieved. As a result, this configuration can apply to a high speed application with high image quality, and can perform more stable ejection. In more particular, as shown in FIGS. 4A1 and 4A2, the base pattern was formed so that the orifice plate had the support structure, which was able to allow an area for disposing the base pattern to be wider and the distance between the mold pattern of the ink flow path and the base pattern to be shorter. Accordingly, the ink jet recording head was able to be obtained to include the orifice plane flatter than that of the ink jet recording head formed by the process using the conventional base shown in FIGS. 4B1 and 4B2.

In addition, the present invention can work well for a type of print head capable of ejecting an extremely small liquid droplet of ink because an air bubble generated by heating a heating resistive element is caused to communicate with ambient air. It is because this type requires that the height of the orifice plane (the distance between the ejection energy generating element 2 and the orifice plane) be controlled with high accuracy to eject an extremely small droplet of ink to the degree of about 1 picoliter.

Exemplary Embodiment 2

Also as described in the exemplary embodiment 1, the base pattern 5, as shown in FIGS. 2A to 2E, also can be formed to be exposed on the side of the orifice plate, and removed from the side of the orifice plate in a later process. Accordingly, the through-hole does not have to be provided.

Figure 2A:
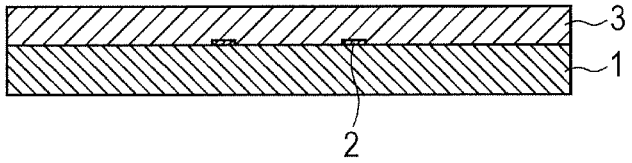
FIGS. 2A, 2B, 2C, 2D and 2E are schematic, cross-sectional process views for illustrating an example of a process for producing a liquid ejection head according to an exemplary embodiment.
Figure 2B:
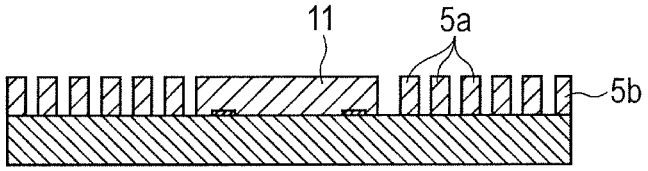
Figure 2C:
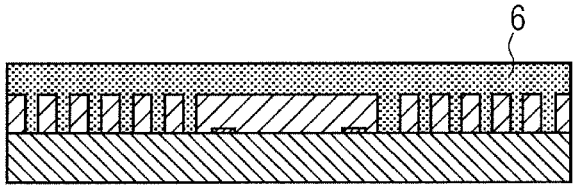
Figure 2D:
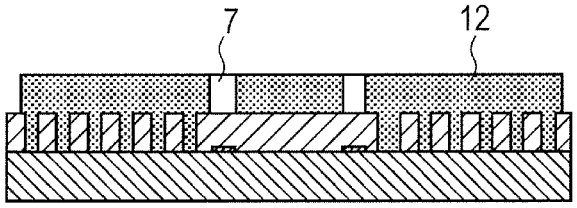
Figure 2E:
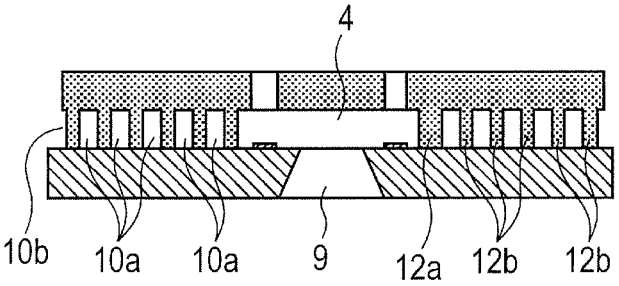
Figure 5A:
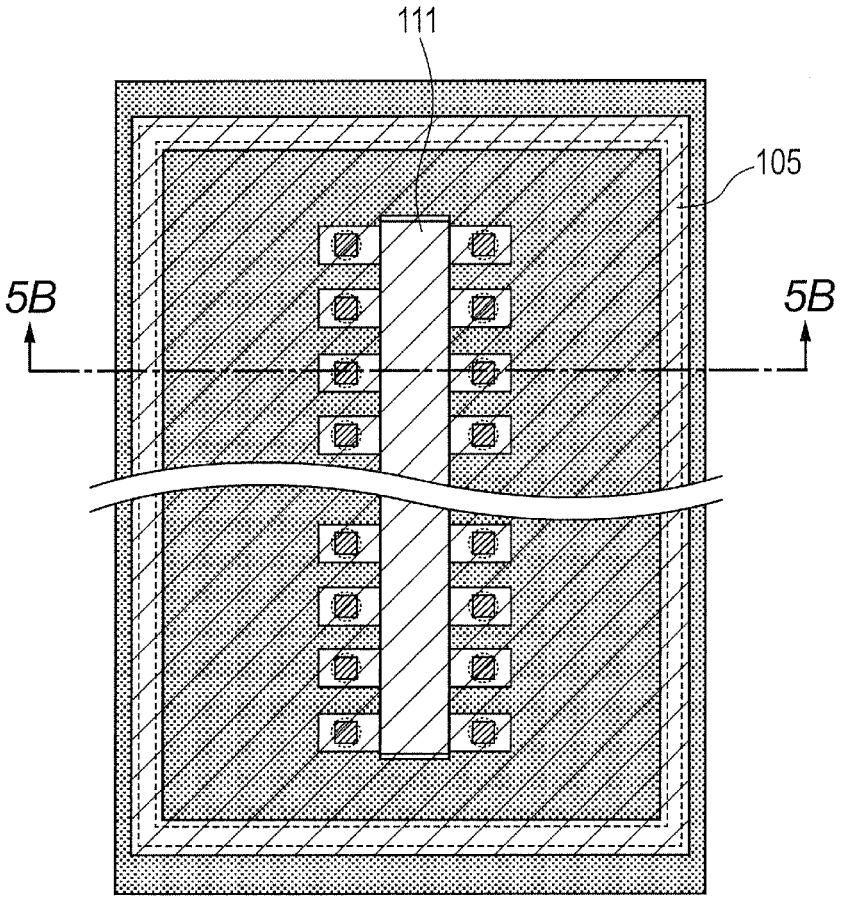
FIG. 5A PRIOR ART
FIGS. 5A and 5B are schematic views for illustrating a base according to a conventional process.
Figure 5B:
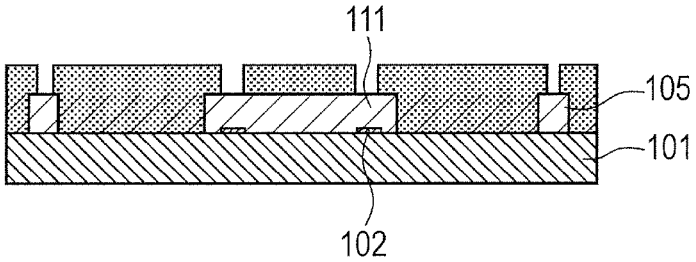
FIG. 5B PRIOR ART
Figure 6A:
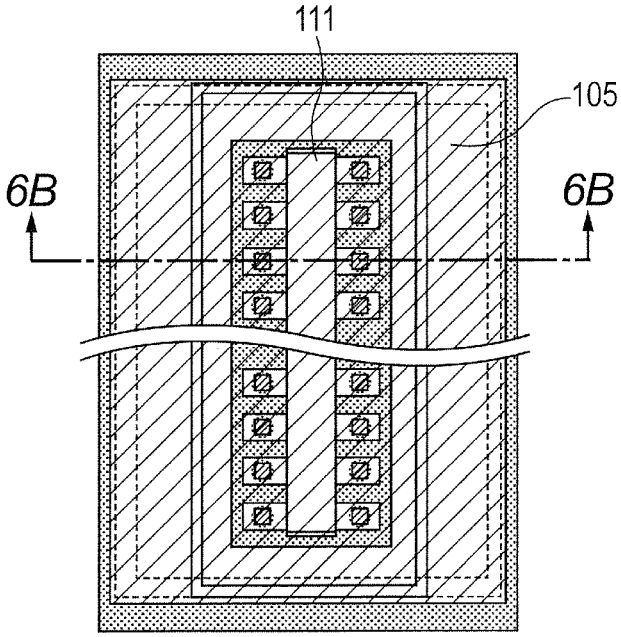
FIG. 6A PRIOR ART
FIGS. 6A, 6B and 6C are schematic, cross-sectional views for illustrating the problem of a liquid ejection head according to a conventional process.
Figure 6B:
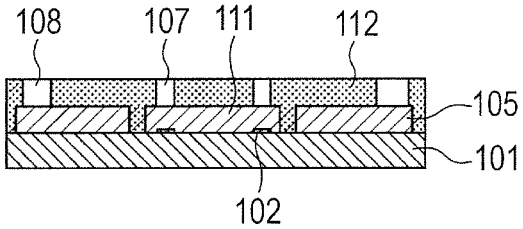
FIG. 6B PRIOR ART
Figure 6C:
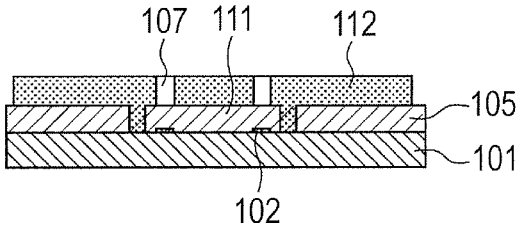
FIG. 6C PRIOR ART

As shown in FIG. 2D, when the orifice plate is formed, it is required that at least a portion of the base pattern 5 be formed to be exposed on the side of the orifice plate. Further, the base pattern can be exposed all around the side of the orifice plate.

Furthermore, the ink jet recording head achieved by this exemplary embodiment can prevent a sealant from heaping on the orifice plane because when the ink jet recording head is joined to a chip tank member, the sealant penetrates into the space formed by the base 5 (the base pattern removed portion).

It is noted that while the figures used for the description illustrate the form in which the orifice plate has one nozzle row formed of the ink ejection orifices and the ink flow paths spatially communicating with each other, respectively, the present invention is not limited to this, and can apply also to a form having a plurality of nozzle rows.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-240299, filed Nov. 1, 2011, which is hereby incorporated by reference herein in its entirety.

What is claimed is:

1. A process for producing a liquid ejection head including an orifice plate having an ejection orifice for ejecting a liquid and a liquid flow path in communication with the ejection orifice, and a substrate having an ejection energy generating element for generating energy for ejecting the liquid, the process comprising:

(1) forming a mold pattern of the liquid flow path and a base pattern surrounding the mold pattern on the substrate;

(2) disposing a covering layer to cover the mold pattern and the base pattern;

(3) forming at least the ejection orifice in the covering layer to form the orifice plate; and (4) removing the mold pattern and the base pattern, wherein the base pattern is formed in such a form that the orifice plate includes a side wall portion constituting a side wall of the liquid flow path and a plurality of support structures that are disposed on the substrate in a peripheral region of the side wall portion and support an upper surface portion constituting an upper wall of the orifice plate, and wherein the base pattern has a mesh form.

2. The process according to claim 1, wherein:

the side wall portion is formed by the covering layer disposed between the base pattern and the mold pattern, and the support structures are formed by the covering layer disposed in the base pattern.

3. The process according to claim 1, wherein the support structures are in one of a pillar form and a wall form connected to the substrate and the upper surface portion.

4. The process according to claim 1, wherein the mesh form is a lattice form.

5. The process according to claim 1, wherein:

in the forming of the at least the ejection orifice, the ejection orifice and a through-hole communicating with the base pattern are formed at the same time in the covering layer, and in the removing of the mold pattern and the base pattern, the base pattern is removed from the through-hole.

6. The process according to claim 1, wherein:

in the forming of the mold pattern, the base pattern is formed so that a portion of the base pattern is exposed on a side of the orifice plate, and in the removing of the mold pattern and the base pattern, the base pattern is removed from the side of the orifice plate.

7. The process according to claim 1, wherein the support structure has the same height as that of the mold pattern.

8. The process according to claim 1, wherein the mold pattern and the base pattern are made of the same material.

* * * * *